US005797486A

United States Patent [19]

Picciolo

[11] Patent Number: 5,797,486

[45] Date of Patent: Aug. 25, 1998

[54] FOOD AND BEVERAGE CARRIER

[76] Inventor: Frank J. Picciolo, 7325 - 14th Ave., Brooklyn, N.Y. 11228

[21] Appl. No.: 731,195

[22] Filed: Oct. 7, 1996

Related U.S. Application Data

[60] Provisional application No. 60/024,107, Aug. 16, 1996.

[51] Int. Cl.[6] ..... B65D 75/00

[52] U.S. Cl. ..... 206/194; 206/162; 206/168; 206/427

[58] Field of Search ..... 206/143, 146, 206/147, 153, 154, 158, 162, 168, 188, 194, 199, 427, 429, 459.5, 831

[56] References Cited

U.S. PATENT DOCUMENTS

| | | | |
|---|---|---|---|
| 2,330,699 | 9/1943 | Flamm | 206/147 |
| 3,123,213 | 3/1964 | Kulig | 206/158 |
| 3,661,417 | 5/1972 | Inman | 206/158 |
| 3,958,744 | 5/1976 | Herglotz | 206/831 |
| 4,620,664 | 11/1986 | Kaufman et al. | 206/831 |
| 5,052,552 | 10/1991 | Maroszek | 206/427 |
| 5,320,216 | 6/1994 | Pangborn | 206/153 |

*Primary Examiner*—David T. Fidei
*Attorney, Agent, or Firm*—Jean-Marc Zimmerman

[57] ABSTRACT

A carrier for transporting food and beverage containers having a first container support wall for supporting an upper portion of a food and beverage container, a second container support wall vertically spaced from the first wall for supporting a lower portion of a food and beverage container, wherein a plurality of apertures are disposed in the first and second walls for receiving a food and beverage container. The carrier is structurally reinforced by providing a plurality of reinforcement panels which extend between the first and second walls of the carrier. A detachable coupon-like portion can be optionally provided in at least one of the reinforcement panels.

17 Claims, 3 Drawing Sheets

FOOD AND BEVERAGE CARRIER

This application claims the benefit of Provisional Application No. 60/024,107, filed Aug. 16, 1996.

FIELD OF INVENTION

The present invention relates generally to disposable food and beverage container carriers and more particularly to an improved disposable food and beverage container carrier having a plurality of carrier reinforcement panels which add strength, rigidity and durability to the carrier.

BACKGROUND OF THE INVENTION

Disposable food and beverage container carriers are well known in the prior art. Such carriers are commonly used by spectators at media events like sporting events and musical concerts to transport food and beverage containers obtained at concession stands to the spectator seating or viewing area. In addition, such carriers are also used to carry take-out food and beverage containers from fast food restaurants and delicatessens.

In order to make the use of these disposable food and beverage container carriers economically feasible, such carriers are typically manufactured from a single sheet of paper material, such as cardboard. The cardboard sheet is folded along an arrangement of predefined creases to assemble the carrier. A conventional food and beverage carrier A is shown in FIG. 1. Carrier A shown therein generally comprises a beverage container support tray B and a handle G. Container support tray B includes an upper wall C and a vertically spaced lower wall D. A plurality of circular-shaped apertures E and F are defined respectively in upper and lower walls C and D. Apertures E in upper wall C are aligned directly over apertures F in lower wall D so that food and beverage containers and the like can be placed therein and securely held in carrier A without tilting or sliding around. Handle G extends from the outer surface of upper wall C and includes an elongated finger opening H. Carrier A is manufactured from a single sheet of cardboard which is folded along creases I, J, K and L.

The food and beverage carrier of FIG. 1, and other like carriers, all suffer from a significant drawback, namely that they are rather flimsy in construction. Consequently, when such carriers are fully loaded with filled food or beverage containers, the carriers tend to collapse, tear or fall apart. On some occasions the fully loaded carrier will collapse, tear or fall apart to such a degree as to allow one or more of the filled containers to fall through the container apertures of the carrier.

It is, therefore, an object of the present invention to provide an improved food and beverage container carrier which is more rigid and therefore stronger than conventional prior art food and beverage container carriers in order to insure that filled food or beverages containers can be transported without accidental spillage. It is also an object of the present invention to provide a food and beverage carrier having detachable coupon-like panels.

SUMMARY OF THE INVENTION

An improved carrier for transporting food and beverage containers, wherein said carrier comprises first means for supporting an upper portion of a food and beverage container, second means for supporting a lower portion of a food and beverage container, a plurality of apertures disposed in the first and second means for receiving a food and beverage container, and a plurality of reinforcement panels extending between the first and second means for strengthening and providing additional rigidity to said carrier.

In one embodiment of the carrier of the present invention, the reinforcement panels include recessed portions having indicia thereon. In another embodiment of the carrier of the present invention, said recessed portions include a detachable coupon-like portion. In still another embodiment of the carrier of the present invention, a handle extending from the first means also includes indicia for advertising and the like.

BRIEF DESCRIPTION OF THE DRAWINGS

A more complete understanding of the present invention may be obtained from consideration of the following detailed description in conjunction with the accompanying drawings in which.

DETAILED DESCRIPTION OF THE DRAWINGS

Figure 1:
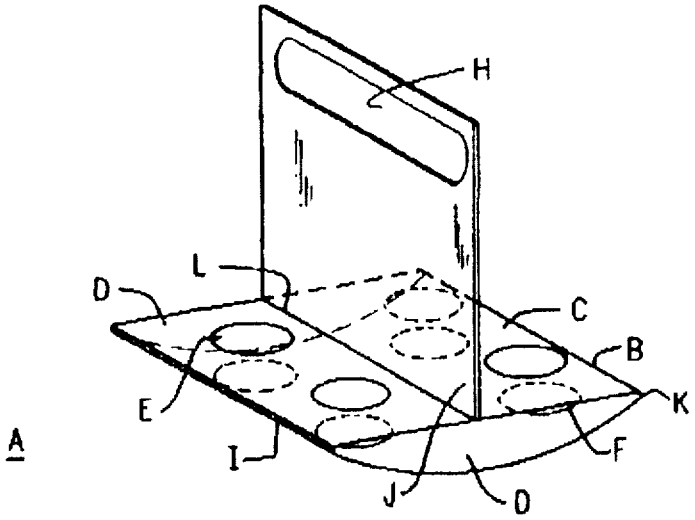
FIG. 1 shows a front plan view of a conventional prior art disposable food and beverage container carrier.
Figure 3:
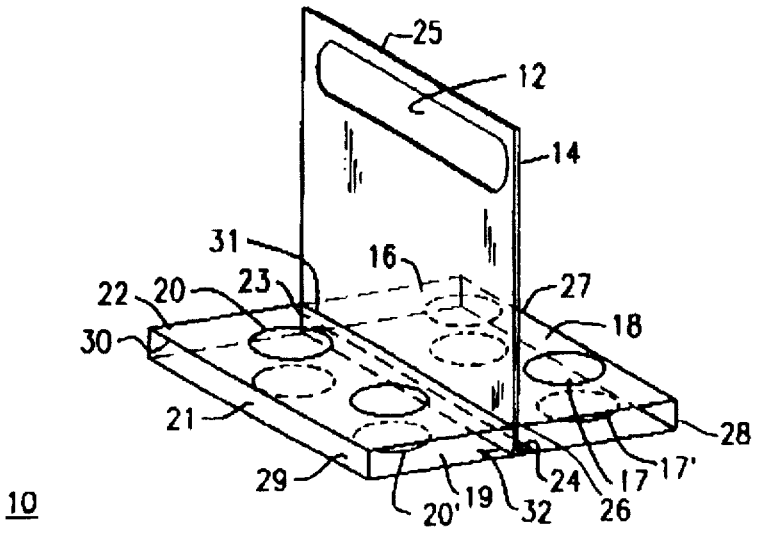
FIG. 3 shows a perspective side view of the food and beverage container carrier of the present invention assembled from the sheet shown in FIG. 2.
Figure 2:
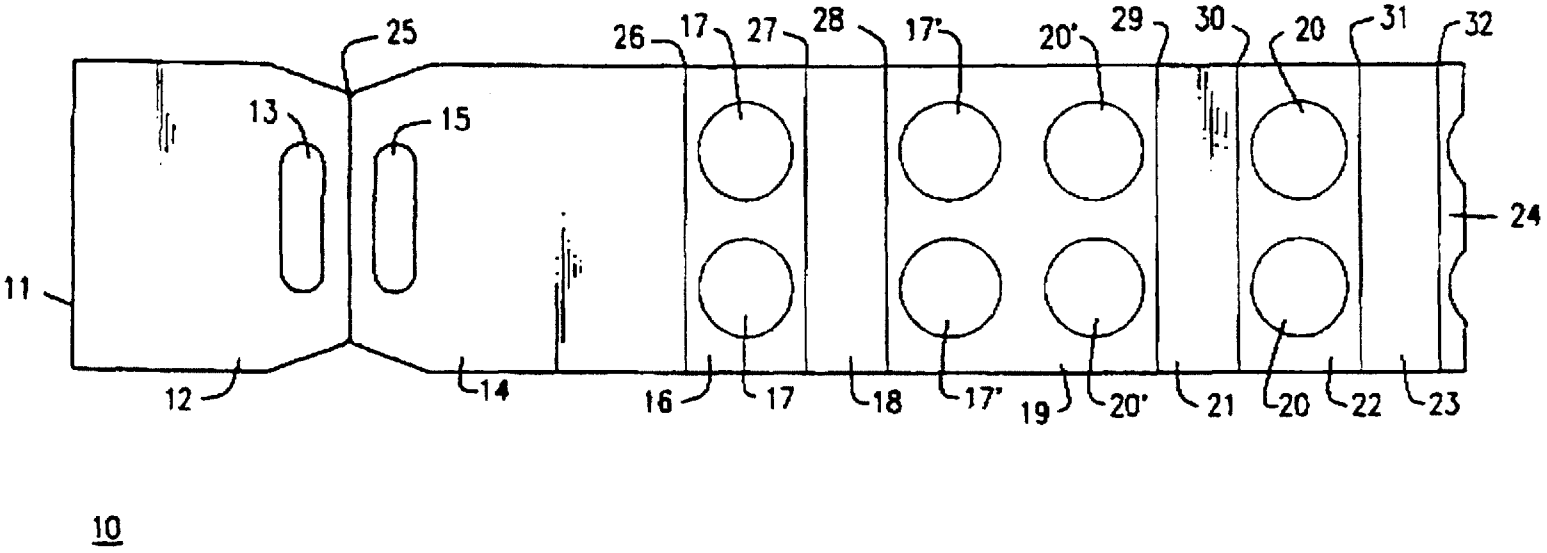
FIG. 2 shows a top plan view of a single sheet of material from which an exemplary embodiment of the disposable food and beverage container carrier according to the present invention is fabricated.

Referring collectively to FIGS. 2 and 3, a disposable food and beverage container carrier according to the present invention is shown and denoted by the numeral 10. FIG. 2 shows a single sheet of material 11, such as cardboard or plastic, from which carrier 10 is assembled is shown in FIG. 3. Sheet 11 is divided by creases 25, 26, 27, 28, 29, 30, 31 and 32 into nine panels 12, 14, 16, 18, 19, 21, 22, 23 and 24.

When sheet 11, as shown in FIG. 2, is assembled into carrier 10, as shown in FIG. 3, panels 12 and 14, which each define an elongated finger opening 13 and 15, will form the handle of carrier 10. Panels 16, 18, 19, 21, 22, 23 and 24 will form the container support tray of carrier 10. In particular, panels 16 and 22 will form the upper container support wall of the container support tray and panel 19 will form the lower container support wall of the container support tray. Panels 16 and 22 define respective container apertures 17 and 20. Panel 19 defines container apertures 17' and 20'.

Panels 18, 21, 23 and 24 operate as reinforcement panels to add rigidity to the container support tray made up of panels 16, 22 and 19, and thus substantially prevent the support tray from collapsing, tearing or falling apart.

Carrier 10 is assembled from sheet 11 as follows. First, panel 12 is folded against panel 14 along crease 25 to form the vertically extending carrying handle for the carrier 10. Next, panel 16 is folded perpendicularly upwards relative to the folded together panels 14 and 12 along crease 26 to form one half of the upper container support wall of carrier 10. Carrier reinforcement panel 18 is then folded perpendicularly relative to panel 16 along crease 27. Then, panel 19 is folded perpendicularly relative to carrier reinforcement panel 18 along crease 28. Next, carrier reinforcement panel 21 is folded perpendicularly relative to panel 19 along crease 29. Panel 22 is then folded perpendicularly relative to carrier reinforcement panel 21 along crease 30. Carrier reinforcement panel 23 is then folded perpendicularly downwards relative to panel 22 along crease 31 to form the second half of the upper container support wall of carrier 10. Finally, carrier reinforcement panel 24 is folded perpendicularly upwards relative to carrier reinforcement panel 23 along crease 32 such that carrier reinforcement panel 23 is vertically positioned, like carrier reinforcement panels 18 and 21, between the upper and lower container support walls of carrier 10 and carrier reinforcement panel 24 is horizontally positioned along the interior surface of the lower container support wall, thereby providing additional rigidity to the container support tray of carrier 10. The panels of the assembled carrier 10 are maintained in a folded manner by any well known pressure sensitive adhesive such as glue or any similar substance. Carrier 10 can be fabricated to have any desired number of container apertures, wherein said apertures can be of any desired size or mix of sizes.

Figure 4:
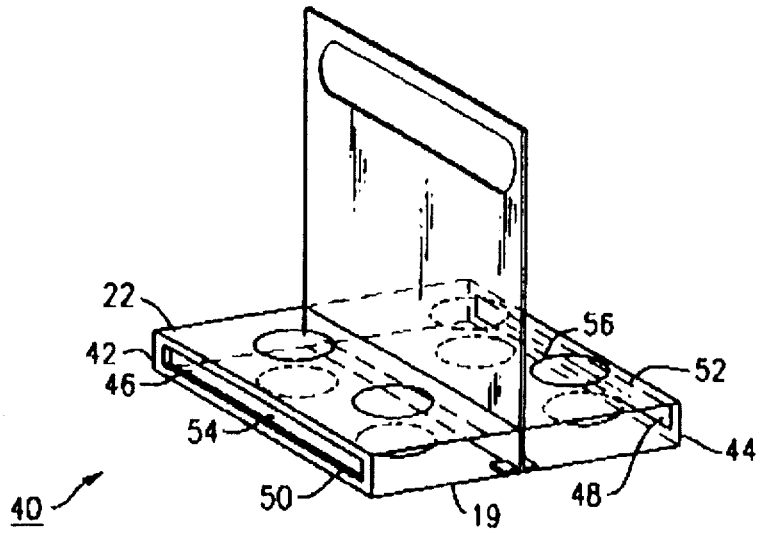
FIG. 4 shows a perspective side view of a second embodiment of the food and beverage container carrier of the present invention.
Figure 5:
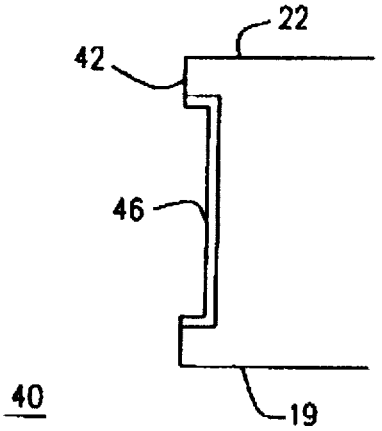
FIG. 5 shows a side view of one of the reinforcement panels and the recessed panel therein of the food and beverage container carrier shown in FIG. 4.

FIG. 4 shows a perspective side view of a second embodiment of the carrier according to the present invention, wherein said carrier is denoted by the numeral 40. Carrier 40 differs from the first embodiment described above and shown in FIG. 3 by the inclusion of recessed panels 46 and 48 which are defined in carrier reinforcement panels 42 and 44, respectively. Recessed panels 46 and 48 are fabricated in such a manner as to add more rigidity to panels 42 and 44, such as by being of a greater thickness than panels 42 and 44 as shown in FIG. 5, thereby strengthening panels 46 and 48, and carrier 40. Panels 46 and 48 can be used to advertise goods and/or services by the inclusion of indicia 54 and 56 thereon. In addition, and as shown in FIG. 4, recessed panels 46 and 48 can each be perforated along their respective borders 50 and 52 so as to allow panels 46 and 48 to be easily torn from carrier 40 and used as purchasing coupons or the like. In both embodiments of the present invention, the panels forming the upper container support wall and handle of the carrier can also include advertising or other descriptive markings thereon. In addition, conventional carrying rests can be provided above the panels which form the upper container support wall.

It will be understood that the embodiment described herein is merely exemplary and that a person skilled in the art may make many variations and modifications to the described embodiment utilizing functionally equivalent elements to those described. Any variations or modifications to the invention just described are intended to be included within the scope of the invention.

What is claimed is:

1. A carrier for transporting food and beverage containers, comprising:

first means for supporting an upper portion of a food and beverage container;

second means for supporting a lower portion of a food and beverage container;

a plurality of apertures disposed in said first and second means for enabling said carrier to receive a food and beverage container; and a plurality of reinforcement panels extending between said first and second means for rigidifying said carrier, wherein at least one of said reinforcement panels includes a recessed panel portion therein.

2. The carrier according to claim 21, wherein said first means comprises an upper container support wall.

3. The carrier according to claim 21, wherein said second means comprises a lower container support wall.

4. The carrier according to claim 21, further comprising means for carrying said carrier, wherein said carrying means extends from said first means.

5. The carrier according to claim 4, wherein said carrying means comprises a handle.

6. The carrier according to claim 5, wherein said handle includes indicia.

7. The carrier according to claim 1, wherein said recessed panel portion includes indicia.

8. The carrier according to claim 7, wherein said recessed panel portion includes a perforated perimeter which enables said recessed panel portion to be easily removed from said reinforcement panel.

9. The carrier according to claim 8, wherein said recessed panel portion having said perforated perimeter and including indicia thereon is a purchasing coupon.

10. A carrier for transporting food and beverage containers, comprising:

a first container support wall for supporting an upper portion of a food and beverage container;

a second container support wall spaced vertically from said first container support wall for supporting a lower portion of a food and beverage container;

a plurality of apertures disposed in said first and second container support walls for receiving a food and beverage container; and a plurality of reinforcement panels extending between said first and second container support walls for adding structurally rigidity to said first and second container support walls, wherein at least one of said reinforcement panels has a side surface which is adhesively coupled to the interior of one of said first and second container support walls, and at least another one of said reinforcement panels includes a recessed panel portion therein.

11. The carrier according to claim 10, wherein said first container support wall comprises a pair of panels.

12. The carrier according to claim 10, wherein said second container support wall comprises a single panel.

13. The carrier according to claim 10, further comprising a handle extending from said first container support wall.

14. The carrier according to claim 13, wherein said handle includes indicia.

15. The carrier according to claim 10, wherein said recessed panel portion includes indicia.

16. The carrier according to claim 15, wherein said recessed panel portion includes a perforated perimeter which enables said recessed panel portion to be easily removed from said reinforcement panel.

17. The carrier according to claim 16, wherein said recessed panel portion having said perforated perimeter and including indicia thereon is a purchasing coupon.

* * * * *